United States Patent [19]

Schmidt

[11] Patent Number: 4,953,759

[45] Date of Patent: Sep. 4, 1990

[54] METERING VALVE FOR DISPENSING AEROSOLS

[75] Inventor: William J. Schmidt, Xenia, Ohio

[73] Assignee: Vernay Laboratories, Inc., Yellow Springs, Ohio

[21] Appl. No.: 338,800

[22] Filed: Apr. 14, 1989

[51] Int. Cl.[5] ..... B05B 1/00

[52] U.S. Cl. ..... 222/402.2; 222/402.24

[58] Field of Search ..... 212/402.2, 402.24; 141/3, 20

[56] References Cited

U.S. PATENT DOCUMENTS

| | | | |
|---|---|---|---|
| 2,998,168 | 1/1958 | Waldherr | 222/402.2 |
| 3,104,785 | 7/1963 | Beard | 222/402.2 |
| 3,123,261 | 3/1964 | Gorman | 222/394 |
| 3,190,508 | 6/1965 | Peterson | 222/394 |
| 3,235,135 | 2/1966 | Robert et al. | 202/402.2 |
| 3,405,846 | 6/1966 | Klun | 222/402.24 |
| 3,464,596 | 9/1969 | Meshberg | 222/402.2 |
| 3,547,317 | 12/1970 | Green | 222/402.2 |
| 3,591,059 | 6/1971 | Stearns | 222/402.20 |
| 3,727,806 | 4/1973 | Wilmot | 222/402.2 |
| 4,433,797 | 2/1984 | Galia | 222/402.2 |
| 4,702,400 | 10/1987 | Corbett | 222/402.2 |
| 4,744,495 | 5/1988 | Warby | 222/402.16 |

FOREIGN PATENT DOCUMENTS 2178398 2/1987 United Kingdom .

*Primary Examiner*—Andres Kashnikow
*Assistant Examiner*—W. T. Waffner
*Attorney, Agent, or Firm*—Biebel, French & Nauman

[57] ABSTRACT

A metering valve assembly for dispensing measured quantities of an aerosol from a pressurized container comprises a housing constructed for sealed attachment to a pressurized container and having therein a partition wall of resilient material enclosing a metering chamber. An operating member is supported in the housing for movement between charging and dispensing petitions. In the charging position of the operating member, a charging connection is established between the interior of the pressurized container and the interior of the metering chamber to fill the chamber with a pressurized charge. In the dispensing position of the operating member, the metering chamber is shut off from the interior of the container and connected to a dispensing outlet, whereupon the pressure within the container will collapse the resilient partition wall and thereby force the contents of the metering chamber to the dispensing outlet. This valve assembly is also effective, in the dispensing position of the operating member, to charge the container with pressurized aerosol by connecting its dispensing outlet to a supply source from which pressurized aerosol enters the container by expanding the inner end of the resilient partition wall to create an opening through which it flows into the interior of the container.

6 Claims, 1 Drawing Sheet

2
2
10
11
11
15
15
15
16
17
17
20
20
21
22
25
25
26
26
30
30
31
31
32
32
33
33
40
41
42
43
44
45
45
46
46
47
47
50
51
52
55
56
60
60
61
61
62
62
63
65
65
150
151
152
153
156

METERING VALVE FOR DISPENSING AEROSOLS

BACKGROUND OF THE INVENTION

This invention relates to a metering valve for dispensing a measured quantity of an aerosol from an aerosol container which is pressurized by a compressed gas such as air, nitrogen, or carbon dioxide.

Valves for this purpose are well known, and a typical example of such a prior art dispensing valve is disclosed in British patent application of Bespak PLC No. 2,178,398, published Feb. 11, 1987 as described in detail hereinafter. The invention is particularly concerned with such valves which include a metering chamber inside the container and a valve stem movable between a charging position wherein it connects the metering chamber with the interior of the container in order to fill the metering chamber with aerosol, and a dispensing position wherein it disconnects the metering chamber from the interior of the container and connects it to the dispensing outlet.

A problem which is common to all prior valves of this type is that although the metering chamber is initially charged with a dose which is under the same pressurized conditions as the other contents of the container, when the metering chamber is shut off from the interior of the container and connected to the atmosphere, the discharge of the metered dose is simply the result of the dissipation of the pressure force which was stored in the metering chamber, and which therefore constitutes a rapidly declining force.

SUMMARY OF THE INVENTION

The primary purpose and object of the invention is to provide a metering valve for the purpose outlined above which is such structure and operating characteristics that the full pressure of the contents of the container is utilized to propel each metered dose from within the container to the dispensing outlet.

In order to accomplish this object, the valve assembly includes a cup-shaped diaphragm having a resilient wall which forms the outer wall of the metering chamber and has its outer surface exposed to the pressurized contents of the container. The valve assembly also includes a tubular valve member movable between a charging position, wherein it opens a connection from the interior of the container to the metering chamber, and a dispensing position wherein it connects the metering chamber with the dispensing outlet. In this position of the valve member, the outer surface of the diaphragm will be exposed to the pressure within the container, and this pressure will collapse the diaphragm wall and therefore force the contents of the metering chamber to the dispensing outlet of the valve member.

The practical result thus achieved by the invention is that where with conventional constructions, the pressure impelling the metered dose out through the dispensing outlet dissipates proportionately to the rate of discharge, with the valve assembly of the invention, the discharge of each measured dose is under the full pressure of the contents of the container, as it collapses the cylindrical wall of the metering chamber and forces its contents to and through the dispensing outlet of the valve member.

Other objects and advantages of the invention, and the means by which they are achieved, will be apparent from or pointed out in the course of the description of the preferred embodiment which follows.

DESCRIPTION OF THE PREFERRED EMBODIMENT

Figures 1, 2, 3:
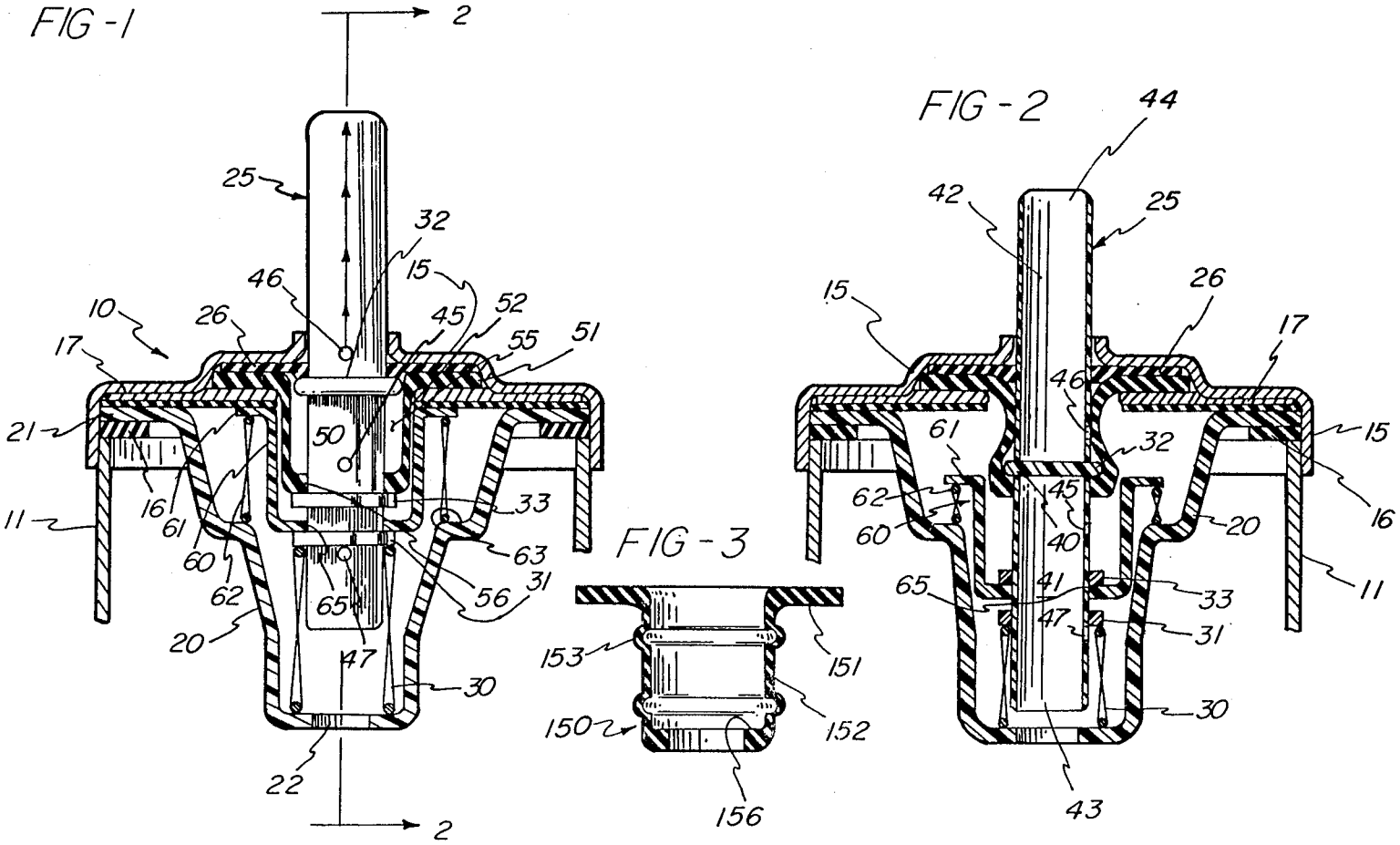
FIG. 1 is a view in axial section of a valve assembly in accordance with the invention wherein the valve member is shown in its normal rest position, which is its charging position.
FIG. 2 is a section generally on the line 2—2 of FIG. 1 showing the valve member in its dispensing position.
FIG. 3 is a detail view partly in elevation and partly in section showing a modified construction of diaphragm for use in the valve assembly of FIGS. 1 and 2.

In FIG. 1 the valve assembly indicated generally at 10 is intended for attachment to an ordinary aerosol container which is indicated diagrammatically and fragmentarily at 11, and which has its contents pressurized by a compressed gas such as air, nitrogen or carbon dioxide. The assembly 10 includes a main housing 15 in the form of a cap for attachment to the container 11, and whatever seals are required for pressure-tight connection to the container 11 are provided in the interior of housing 10, as indicated at 16 and 17.

A rigid housing 20 of generally cup-shape is mounted in the housing 15, preferably by securing its peripheral rim 21 between seals 16 and 17 as shown. The housing 20 includes at least one opening 22 between its interior and the interior of the container for free flow of the contents of the container into the interior of the housing 20.

The main operating member of the valve assembly 10 is a tubular valve member 25 which is mounted for lengthwise movement with respect to housings 15 and 20 through an annular seal 26 secured to the top wall of housing 11. The valve member 25 is biased outwardly of housing 10 by a compression spring 30 positioned between the bottom of housing 20 and a circumferential shoulder 31 on valve member 25. FIG. 1 shows the valve member 25 in its normal rest position, wherein a second circumferential shoulder 32 thereon abuts the seal 26, this being the charging position of the valve member 25. A third circumferential shoulder 33 on valve member 25 is also provided, and its purpose is described hereinafter.

The valve member 25 is open throughout its length except for an internal wall 40 (FIG. 2) at approximately its mid-point which divides the interior of member 25 into an inlet chamber 41 and a discharge chamber 42 within the opposite ends of valve member 25. The valve member 25 has its inner end 43 open to form an inlet port to inlet chamber 41, and its outer end 44 is also open and forms the dispensing outlet from chamber 42. A port 45 in the side wall of valve member 25, which is spaced lengthwise of the valve member from the inlet port 43, forms the outlet port from chamber 41, and a similar port 46 on the opposite side of shoulder 32 from port 45 forms the supply port to discharge chamber 42. A port 47 between shoulder 31 and the adjacent end of valve member 25 may be used as the inlet port to inlet chamber 41 rather than having the end 43 of valve member 25 open.

A cup-shaped diaphragm 50 includes a peripheral rim 51 by which it is firmly mounted in the outer end of housing 15 adjacent the annular seal 26, which has sliding sealing engagement with the outer surface of valve member 25. A tubular side wall 52 of diaphragm 50 acts as a partition wall and is of sufficiently larger inner diameter than the outer diameter of valve member 25 to form therebetween an annular chamber 55 which constitutes the metering chamber of this valve assembly. The end wall 56 of diaphragm 50 is annular and is in slidable sealing engagement with the portion of valve member 25 between the circumferential shoulders 32 and 33.

The valve assembly 10 also includes a cup-shaped housing 60 which has the primary purpose of protecting the diaphragm 50 during refilling of the metering chamber. The housing 60 also is useful during initial charging of the container 11, as described hereinafter, but it may be omitted if the diaphragm 50 is adequately self-supporting.

The housing 60 includes a peripheral rim 61, and a compression spring 62 is positioned between this rim 61 and an annular shoulder 63 on housing 20 to bias the housing 60 into a normal position of engagement with the seal 17. The bottom of housing 60 has a central opening 65 through which the valve member 25 is freely slidable to the extent permitted by the shoulder 33. In addition, the housing 60 may have one or more openings in the side wall thereof to assure equalizing of the pressure inside and outside the diaphragm 50 with the parts in the charging position shown in FIG. 1.

FIG. 1 shows the movable component parts of valve assembly 10 in their normal or rest positions, which establish the charging position for the valve member 25. In this position, the discharge chamber 42 is open to the atmosphere, but it is sealed from the interior of the container 11 because its supply port 46 is outside of the seal 26. At the same time, the inlet chamber 41 provides open communication between the interior of container 11 and the annular metering chamber 55, through port 43, inlet chamber 41 and port 45. Since the contents of container 11 are pressurized, the result will be to fill the metering chamber 55 with fluid under the same pressurized conditions as exist throughout the container 11.

FIG. 2 illustrates the dispensing position of the valve member 25, which is established when it is moved lengthwise into the housing 20 to its inner limit position wherein the shoulder 32 thereon abuts the end wall 56 of cup-shaped diaphragm 50. The relative spacing of the ports 45 and 46 and the seals with which they cooperate is such that during this movement, the outlet port 45 from chamber 41 will first be shut off from chamber 55 by passage through the diaphragm end wall 56, thereby isolating the charge within the metering chamber 55 before the supply port 46 to discharge chamber 42 has moved past seal 26 into open communication with the chamber 55.

During the subsequent movement of valve member 25, the housing 60 will also be moved downwardly against spring 62, by engagement of the circumferential shoulder 33 on valve member 25 with the bottom wall of housing 60. With the parts in these positions, as shown in FIG. 2, the outer surface of the cylindrical side wall 52 of the cup-shaped diaphragm 50 will be exposed to the pressurized contents of the container 11, by way of the inlet chamber 41 and port 45, and also around the housing 60. Since the metering chamber 55 inside this wall is now open to the atmosphere, the pressure forces within the container 11, and specifically within the housing 20, will collapse the diaphragm around valve member 25, as illustrated in FIG. 2.

Therefore, not only will the contents of the metering chamber 55 naturally flow to and through the discharge chamber 42 and into the atmosphere, by reason of their pressurized condition, but that flow will be at an essentially continuous rate by reason of the pressure force exerted by the contents of container 11 as the diaphragm wall 52 collapses. This continuous rate of flow is in contrast to the diminishing rate which results when the outer wall of the metering chamber is rigid, as in the above British patent application.

After the metered dose within chamber 55 has thus been dispensed, release of the valve member 25 will result in its return to the charging position shown in FIG. 1, by the action of the compression spring 30. The diaphragm wall 52 will return to its normal shape shown in FIG. 1, by the combined forces of its elastomeric tension and pressure equilibrium as metering chamber 55 is again charged from the interior of the container 11, by way of the inlet chamber 41 and its ports 43 and 45, and the assembly will again be ready to dispense the next metered dose, as already described.

As previously noted, the housing 60 is an optional component of the valve assembly 10, and it may be omitted without affecting the operation of the assembly. If it is omitted, one or the other of the shoulders 32 and 33 may also be omitted from the valve member 25, and the remaining one of these shoulders will cooperate with the spring 30 as already described. If the housing 60 is used, it contributes to the initial charging of the container 11 through the valve assembly 10, as described below.

Thus referring again to FIG. 2, while the valve member 25 is in its dispensing position, its outlet 44 may be connected to a supply source of the desired pressurized fluid with which the container 11 is to be filled. This fluid will then enter chamber 42, flow through the port 46 into the chamber 55, and then expand the end wall 56 of diaphragm 50 away from the valve member 25 and thereby create an opening between wall 56 and valve member 25 through which it can flow into the annular space between diaphragm 50 and housing 60.

From this space, the fluid will flow through port 45 into the chamber 41 within valve member 25 and thence through the open end port 43 and opening 22 into the interior of container 11. During this operation, the primary contribution by the housing 60 is that its upper portion closely spaced surrounding relation with the lower end of diaphragm 50 and thereby limits the extent to which the end wall 56 of housing 50 is expanded outwardly by the pressurized fluid which forces itself between wall 56 and the outer surface of valve member 25.

It will accordingly be seen that the key to successful practice of the invention lies in the construction of the cup-shaped diaphragm 50, which requires that its side wall 52 be of sufficiently yieldable resiliency for rapid collapse during the discharging phase of the use of the valve assembly 10, and rapid recovery for recharging purposes. It is also desirable that the end wall portion 56 of the diaphragm be sufficiently resilient for expansion by incoming pressurized fluid during charging of the container 11 as just described.

FIG. 3 shows an alternative construction of a cup-shaped diaphragm 150 which may be used in place of the diaphragm 50 in assembly 10. It includes a similar peripheral rim 151, but its side wall 152 includes a plurality of circumferential ribs 153 which provide both extra flexibility under pressure but also greater rigidity in the charged condition of the valve assembly. The diaphragm 150 also includes an end wall 156 which operates as a sliding seal in the same manner as shown and described with respect to the end wall 56 of diaphragm 50.

While the articles herein described constitute preferred embodiments of the invention, it is to be understood that the invention is not limited to these precise articles and that changes may be made therein without departing from the scope of the invention which is defined in the appended claims.

What is claimed is:

1. A metering valve assembly for dispensing measured quantities of an aerosol from a pressurized container, comprising:

(a) an annular member forming a cap for sealed attachment to a pressurized container, (b) a main housing attached to said cap and adapted to depend therefrom in said container with the interior thereof open to said container, (c) a tubular valve member supported in said cap and housing for lengthwise movement between charging and dispensing positions, (d) said valve member having an internal wall separating the interior thereof into an inlet chamber and a discharge chamber within the inner and outer ends of said valve member, (e) said discharge chamber having a supply port in the side thereof adjacent said wall and a dispensing outlet spaced lengthwise of said valve member from said supply port and open to the atmosphere, (f) said inlet chamber having an outlet port adjacent said wall and an inlet port spaced from said outlet port lengthwise of said valve member and open to the interior of said container, (g) diaphragm means within said housing including a partition wall of resilient material surrounding said valve member and of normally larger inner periphery than the outer periphery of said valve member to define therewith an annular metering chamber, (h) inner and outer annular seal means forming the opposite inner and outer ends of said metering chamber and having slidable sealing engagement with said valve member, and (i) said supply and outlet ports being located in predetermined spaced relation on said valve member such that when said valve member is in said charging position, said supply port will be sealed from said metering chamber and said outlet port will be open to said metering chamber for flow of the contents of said container into said metering chamber, and when said valve member is in said dispensing position, said outlet port will be sealed from said metering chamber and said supply port will be open to said metering chamber, (j) whereby upon movement of said valve member from said charging position to said dispensing position, the pressure within said container will collapse said diaphragm wall and thereby force the contents of said metering chamber through said supply port to said dispensing outlet.

2. A metering valve assembly as defined in claim 1, further comprising means in said housing biasing said valve member to said charging position thereof.

3. A metering valve assembly as defined in claim 1, further characterized in that said inner annular seal means at said inner end of said metering chamber is of resilient material whereby said container may be charged with pressurized aerosol by connecting said dispensing outlet to a supply source of pressurized aerosol while said valve member is in said dispensing position to cause said aerosol to expand said seal means away from said valve member and to flow through the resulting opening into the interior of said container.

4. A metering valve assembly for dispensing measured quantities of an aerosol from a pressurized container, comprising:

(a) an annular member forming a cap for sealed attachment to a pressurized container, (b) a main housing attached to said cap and adapted to depend therefrom in said container with the interior thereof open to said container, (c) a tubular valve member supported in said cap and housing for lengthwise movement between charging and dispensing positions, (d) said valve member having an internal wall separating the interior thereof into an inlet chamber and a discharge chamber within the inner and outer ends of said valve member, (e) said discharge chamber having a supply port in the side thereof adjacent said wall and a dispensing outlet spaced lengthwise of said valve member from said supply port and open to the atmosphere, (f) said inlet chamber having an outlet port adjacent said wall and an inlet port spaced from said outlet port lengthwise of said valve member and open to the interior of said container, (g) a cup-shaped diaphragm secured at the open end thereof to said cap and including a tubular side wall of resilient material extending inwardly of said housing in exposed relation to the interior of said housing and in surrounding relation with said valve member, (h) said diaphragm side wall being of normally larger inner periphery than the outer periphery of said valve member to define therewith an annular metering chamber, (i) said diaphragm including an annular inner end wall in slidably sealing relation with the outer surface of said valve member and cooperating therewith to seal the inner end of said metering chamber, (j) annular seal means in said cap cooperating with said valve member to seal the outer end of said metering chamber, and (k) said supply and outlet ports being located in predetermined spaced relation on said valve member such that when said valve member is in said charging position, said supply port will be sealed from said metering chamber and said outlet port will be open to said metering chamber for flow of the contents of said container into said metering chamber, and when said valve member is in said dispensing position, said outlet port will be sealed from said metering chamber by said diaphragm end wall and said supply port will be open to said metering chamber, (l) whereby upon movement of said valve member from said charging position to said dispensing position, the pressure within said container will collapse said diaphragm side wall and thereby force the contents of said metering chamber through said supply port to said dispensing outlet.

5. A metering valve assembly as defined in claim 4 further characterized in that said annular inner end wall of said diaphragm is of resilient material whereby said container may be charged with pressurized aerosol by connecting said dispensing outlet to a supply source of pressurized aerosol while said valve member is in said dispensing position to cause said aerosol to expand said diaphragm end wall away from said valve member and to flow through the resulting opening into the interior of said container.

6. A metering valve assembly as defined in claim 5 further comprising a cup-shaped housing surrounding said diaphragm and having an opening at the inner end thereof receiving said valve member therethrough, means for connecting said cup-shaped housing to said valve member for movement therewith to a position surrounding said diaphragm end wall when said valve member is in said dispensing position, and said cup-shaped housing being dimensioned to limit expansion of said diaphragm end wall while said container is being charged with pressurized aerosol as specified in claim 7.

* * * * *

UNITED STATES PATENT AND TRADEMARK OFFICE

CERTIFICATE OF CORRECTION

PATENT NO. : 4,953,759

DATED : September 4, 1990

INVENTOR(S) : William J. Schmidt

It is certified that error appears in the above-identified patent and that said Letters Patent is hereby corrected as shown below:

On the title page, item [56]
In the "References Cited":

"Peterson" should be --Petersen--.

Klun - "6/1966" should be --10/1968--.

Waldherr - "1/1958" should be --8/1961--.

Column 8, line 9
Claim 6, line 11, the reference numeral "7"

should be --5--.

Signed and Sealed this

Third Day of March, 1992

*Attest:*

HARRY F. MANBECK, JR.

*Attesting Officer*

*Commissioner of Patents and Trademarks*